US009482119B2

(12) United States Patent
Evans

(10) Patent No.: US 9,482,119 B2
(45) Date of Patent: Nov. 1, 2016

(54) SWITCHING ROLLER FINGER FOLLOWER WITH END STOPS IN SECONDARY ARMS

(71) Applicant: Schaeffler Technologies GmbH & Co. KG, Herzogenaurach (DE)

(72) Inventor: Matthew Evans, Warren, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 130 days.

(21) Appl. No.: 14/532,752

(22) Filed: Nov. 4, 2014

(65) Prior Publication Data

US 2015/0135893 A1 May 21, 2015

Related U.S. Application Data

(60) Provisional application No. 61/905,527, filed on Nov. 18, 2013.

(51) Int. Cl.
*F01L 1/34* (2006.01)
*F01L 1/18* (2006.01)

(52) U.S. Cl.
CPC ..... *F01L 1/18* (2013.01); *Y10T 29/49556* (2015.01); *Y10T 74/2107* (2015.01)

(58) Field of Classification Search
CPC ..... F01L 1/18; F16H 25/14
USPC ..... 123/90.16, 90.39
See application file for complete search history.

(56) References Cited

U.S. PATENT DOCUMENTS

| | | | | |
|---|---|---|---|---|
| 7,174,869 | B2 | 2/2007 | Proschko et al. | |
| 7,909,007 | B2 | 3/2011 | Manther et al. | |
| 2008/0149059 | A1* | 6/2008 | Murphy | F01L 1/18 123/90.39 |
| 2011/0197843 | A1 | 8/2011 | Manther | |

* cited by examiner

*Primary Examiner* — Zelalem Eshete
(74) *Attorney, Agent, or Firm* — Simpson & Simpson, PLLC

(57) ABSTRACT

A switching roller finger follower including: a housing including first and second walls; a first secondary arm pivotably connected to the housing and including a first groove; a second secondary arm pivotably connected to the housing and including a second groove; and a roller disposed between the first and second walls and including an axle passing through the walls and having a first end disposed in the first groove and a second end disposed in the second groove. A method of fabricating a switching roller finger follower, including: disposing a roller between first and second walls for a housing; passing an axle through the roller and the walls; pivotably connecting first and second secondary arms to the housing; disposing a first end of the axle in a first groove in the first arm; and disposing a second end of the axle in a second groove in the second arm.

19 Claims, 10 Drawing Sheets

SWITCHING ROLLER FINGER FOLLOWER WITH END STOPS IN SECONDARY ARMS

CROSS-REFERENCE TO RELATED APPLICATIONS

This application claims the benefit under 35 U.S.C. §119 (e) of U.S. Provisional Patent Application No. 61/905,527, filed Nov. 18, 2013, which application is incorporated herein by reference in its entirety.

TECHNICAL FIELD

The present disclosure relates to a switching roller finger follower with secondary arms having ends stops formed by grooves in the secondary arms. Respective ends of an axle for a roller bearing in the switching roller finger follower are configured to engage the ends stops to limit rotation of the secondary arms.

BACKGROUND

FIG. 9 is a perspective view of a protrusion, on housing 300 of a prior art switching roller finger follower, for engaging ends stops on a secondary arm.

FIG. 10 is a perspective view of end stops on prior art secondary arm 302. The following should be viewed in light of FIGS. 9 and 10. Transport and overswing ends stops are used in switching roller finger followers to prevent excessive rotation of secondary arms, which can cause damage to the follower, as a result of malfunction of the follower.

For example, as is known in the art, a locking pin (not shown) is used to block rotation of the secondary arms during a locked mode. For example, end 304 of arm 302 is arranged to contact the locking pin when force from a cam lobe (not shown) engaged with surface 306 of arm 302 causes arm 302 to rotate in direction RTD1. If the locking pin does not displace the proper distance at the proper time (a mis-switch), the force from the cam lobe causes end 304 to slide past the locking pin so that arm 302 continues to rotate in direction RTD1. Overswing endstop 308, formed in arm 302, is configured to engage protrusion 310 on housing 300 to block further rotation in direction RTD1. However, a large rotational force is imparted to arm 302 by the cam lobe and the magnitude of this force can cause endstop 308 to shear protrusion 310 from housing 300 causing further rotation of arm 302. This further rotation can cause failure of a follower including housing 300 and arm 302. For example, a lost motion spring (not shown) engaged with arm 302 is used to urge arm 302 in direction RTD2, opposite RTD1, as described below. If arm 302 is rotated too far in direction RTD1, the spring is overstressed, resulting in various failure modes for a switching roller finger follower including housing 300 and arm 302.

After a mis-switch in the locked mode, the locking pin retracts to enable rotation of the secondary arm in direction RTD2 via a spring (not shown). Rotation of the secondary arm in direction RTD2 is blocked by contact of transport endstop 312, formed in secondary arm 302, with protrusion 310. The rotation of the secondary arm in direction RTD1 is opposed by the spring force of the spring. The additional rotation of the secondary arm due to the mis-switch results in an increase in the spring force, which further results in an increase of the force applied by endstop 312 to protrusion 310. The magnitude of this force can cause endstop 308 to shear protrusion 310 from housing 300 enabling excess rotation of arm 302 in direction RTD2, which can cause failure of a follower including housing 300 and arm 302.

SUMMARY

According to aspects illustrated herein, there is provided a switching roller finger follower, including: a housing including first and second walls; a first secondary arm pivotably connected to the housing and including a first groove; a second secondary arm pivotably connected to the housing and including a second groove; and a roller disposed between the first and second walls and including a first axle passing through the first and second walls and having a first end disposed in the first groove and a second end disposed in the second groove.

According to aspects illustrated herein, there is provided a switching roller finger follower, including: a housing including first and second walls; a first secondary arm pivotably connected to the housing and including a first groove with first and second ends; a second secondary arm pivotably connected to the housing and including a second groove with third and fourth ends; and a roller disposed between the first and second walls and including a first axle passing through the first and second walls and having a first end disposed in the first groove and a second end disposed in the second groove. The first and third ends block pivoting of the first and second secondary arms in a first direction. The second and fourth ends block pivoting of the first and second secondary arms in a second direction opposite the first direction.

According to aspects illustrated herein, there is provided a method of fabricating a switching roller finger follower, including: disposing a roller between first and second walls for a housing; passing a first axle through the roller and through first and second through-bores in the first and second walls, respectively; pivotably connecting first and second secondary arms to the housing; disposing a first end of the first axle in a first groove in the first secondary arm; and disposing a second end of the first axle in a second groove in the second secondary arm.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

At the outset, it should be appreciated that like drawing numbers on different drawing views identify identical, or functionally similar, structural elements of the disclosure. It is to be understood that the disclosure as claimed is not limited to the disclosed aspects.

Furthermore, it is understood that this disclosure is not limited to the particular methodology, materials and modifications described and as such may, of course, vary. It is also understood that the terminology used herein is for the purpose of describing particular aspects only, and is not intended to limit the scope of the present disclosure.

Unless defined otherwise, all technical and scientific terms used herein have the same meaning as commonly understood to one of ordinary skill in the art to which this disclosure belongs. It should be understood that any methods, devices or materials similar or equivalent to those described herein can be used in the practice or testing of the disclosure.

Figure 1A:
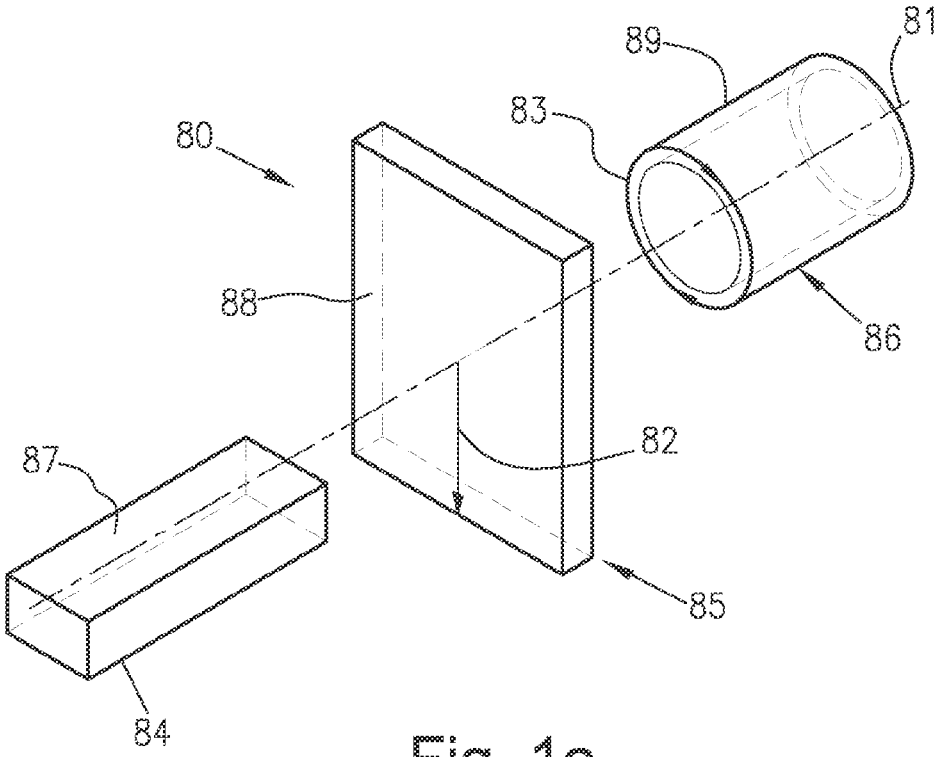
FIG. 1A is a perspective view of a cylindrical coordinate system demonstrating spatial terminology used in the present application.

FIG. 1A is a perspective view of cylindrical coordinate system 80 demonstrating spatial terminology used in the present application. The present invention is at least partially described within the context of a cylindrical coordinate system. System 80 has a longitudinal axis 81, used as the reference for the directional and spatial terms that follow. The adjectives "axial," "radial," and "circumferential" are with respect to an orientation parallel to axis 81, radius 82 (which is orthogonal to axis 81), and circumference 83, respectively. The adjectives "axial," "radial" and "circumferential" also are regarding orientation parallel to respective planes. To clarify the disposition of the various planes, objects 84, 85, and 86 are used. Surface 87 of object 84 forms an axial plane. That is, axis 81 forms a line along the surface. Surface 88 of object 85 forms a radial plane. That is, radius 82 forms a line along the surface. Surface 89 of object 86 forms a circumferential plane. That is, circumference 83 forms a line along the surface. As a further example, axial movement or disposition is parallel to axis 81, radial movement or disposition is parallel to radius 82, and circumferential movement or disposition is parallel to circumference 83. Rotation is with respect to axis 81.

The adverbs "axially," "radially," and "circumferentially" are with respect to an orientation parallel to axis 81, radius 82, or circumference 83, respectively. The adverbs "axially," "radially," and "circumferentially" also are regarding orientation parallel to respective planes.

Figure 1B:
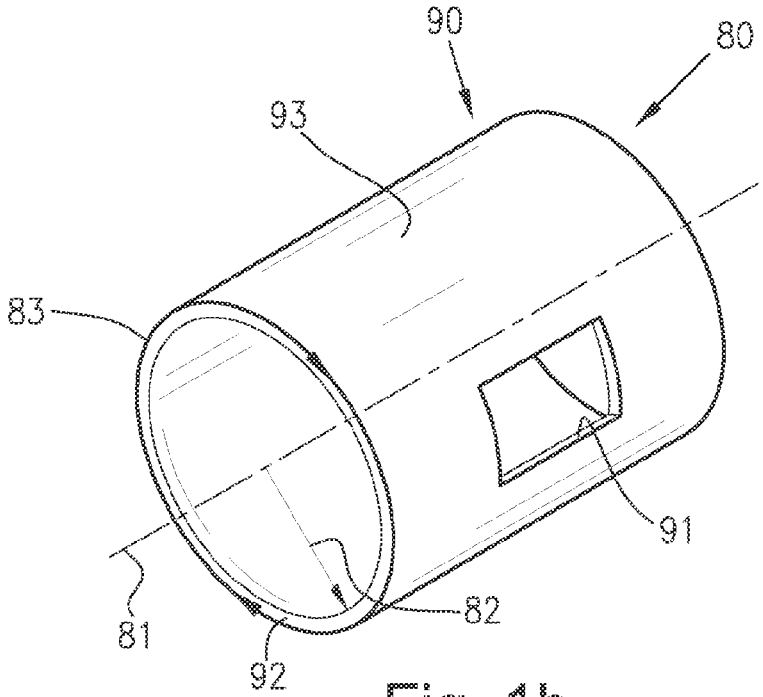
FIG. 1B is a perspective view of an object in the cylindrical coordinate system of FIG. 2A demonstrating spatial terminology used in the present application.

FIG. 1B is a perspective view of object 90 in cylindrical coordinate system 80 of FIG. 1A demonstrating spatial terminology used in the present application. Cylindrical object 90 is representative of a cylindrical object in a cylindrical coordinate system and is not intended to limit the present invention in any manner. Object 90 includes axial surface 91, radial surface 92, and circumferential surface 93. Surface 91 is part of an axial plane, surface 92 is part of a radial plane, and surface 93 is a circumferential surface.

Figure 2:
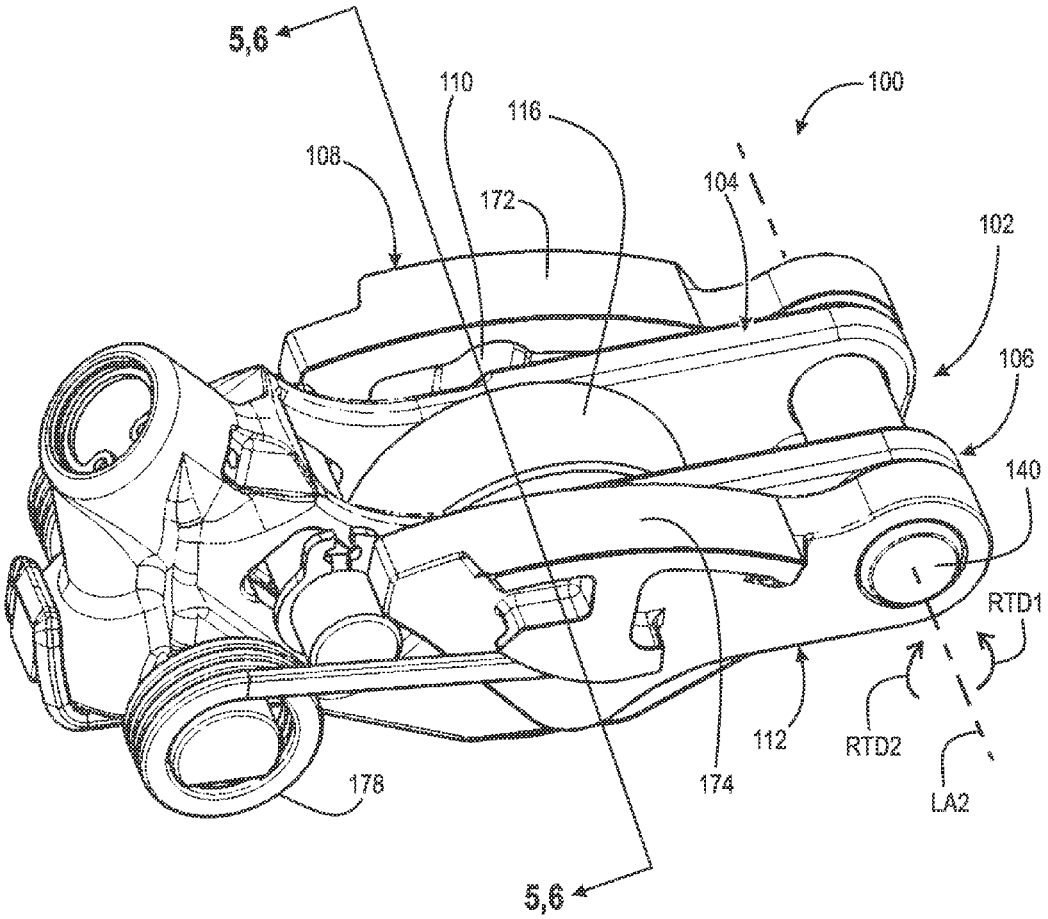
FIG. 2 is a perspective view of a switching roller finger follower with ends stops in secondary arms.

FIG. 2 is a perspective view of switching roller finger follower 100 with ends stops in secondary arms.

Figure 3:
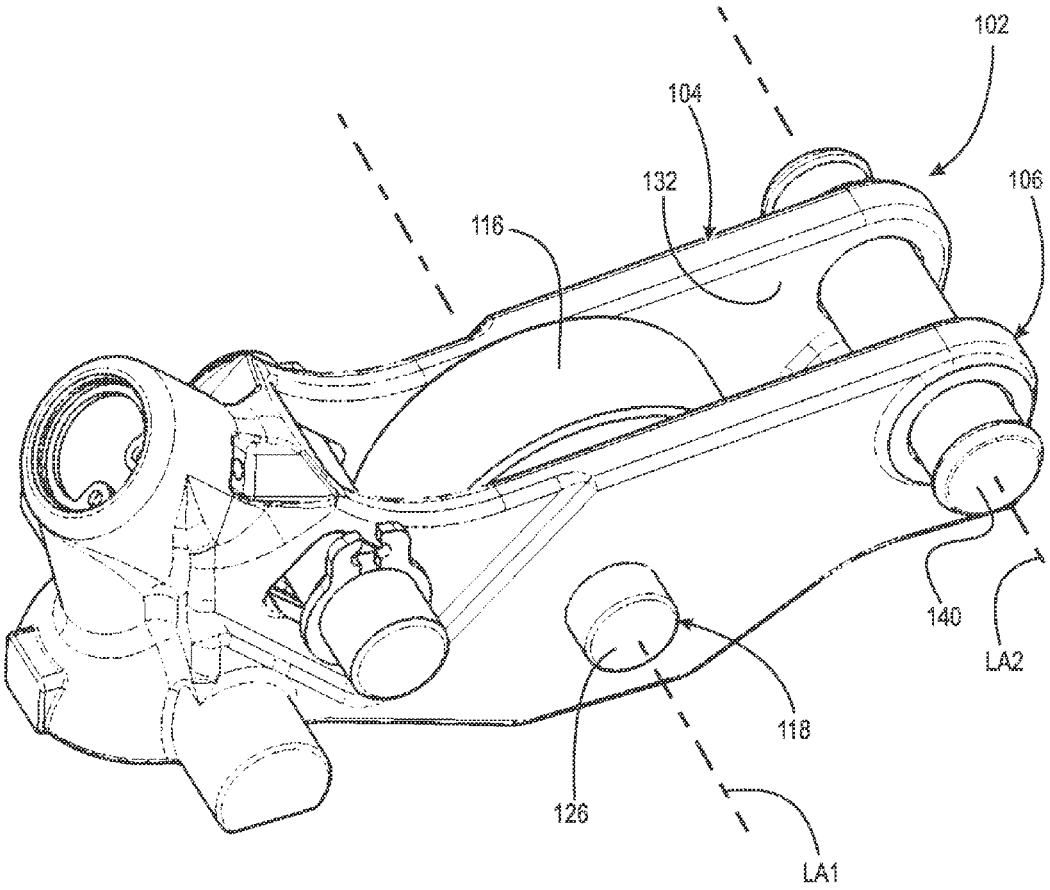
FIG. 3 is perspective view of the switching roller finger follower in FIG. 2 with the secondary arms removed.

FIG. 3 is perspective view of switching roller finger follower 100 in FIG. 2 with secondary arms removed.

Figure 4:
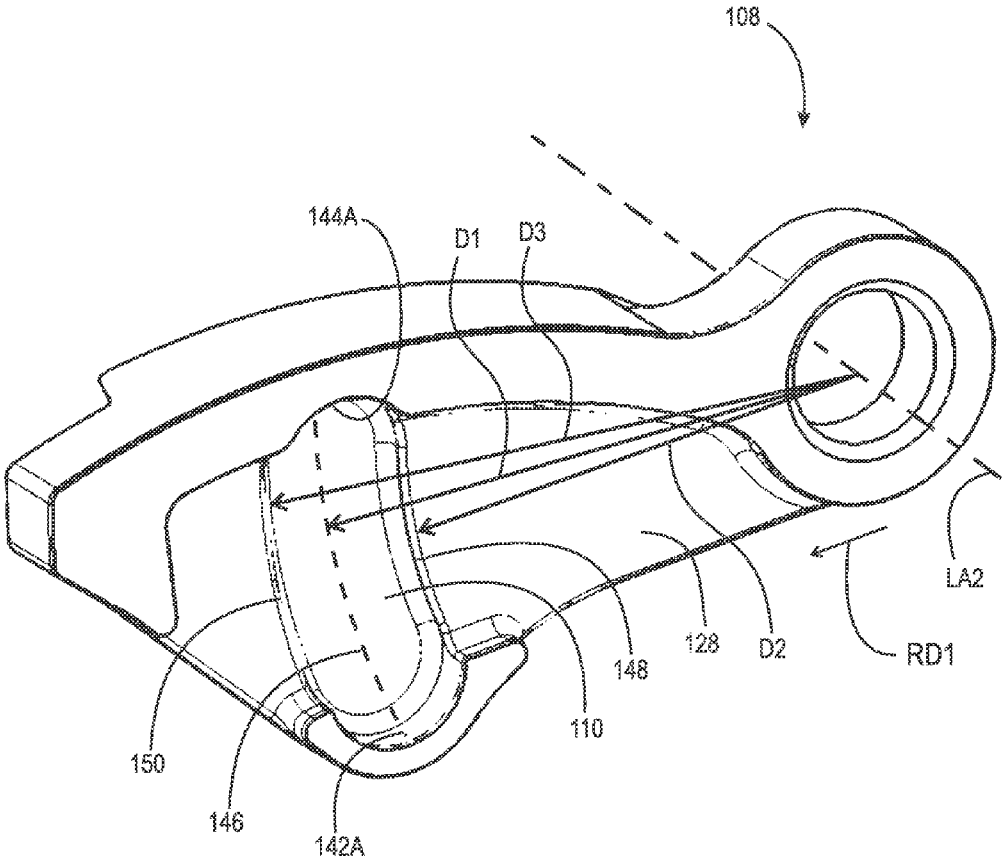
FIG. 4 is a perspective view of a secondary arm from FIG. 2 showing a groove.

FIG. 4 is a perspective view of a secondary arm from FIG. 2 showing a groove.

Figure 5:
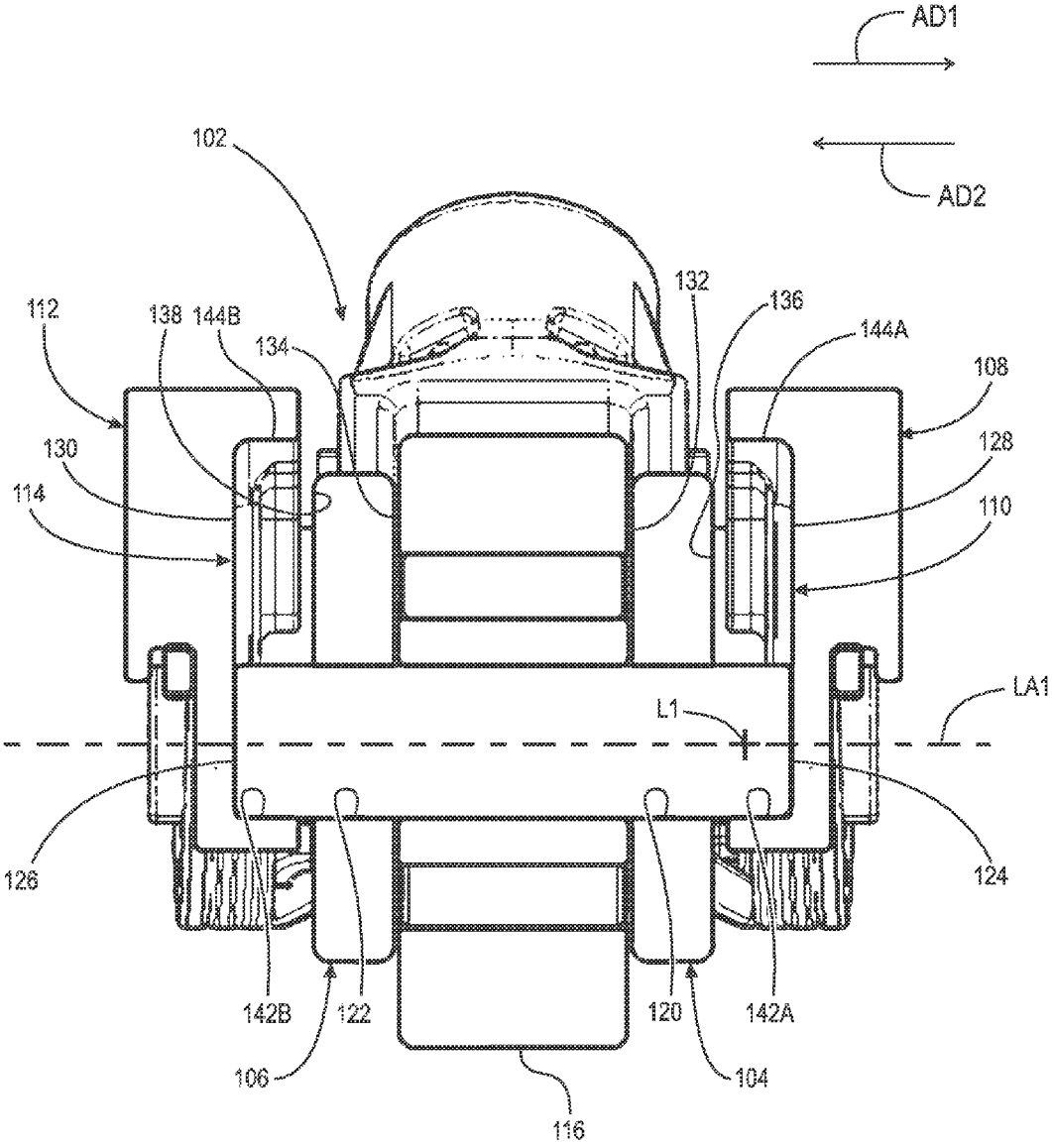
FIG. 5 is a cross-sectional view generally along line 5/6-5/6 in FIG. 2 with the secondary arms contacting transport end stops.

FIG. 5 is a cross-sectional view generally along line 5/6-5/6 in FIG. 2 with the secondary arms contacting transport end stops.

Figure 6:
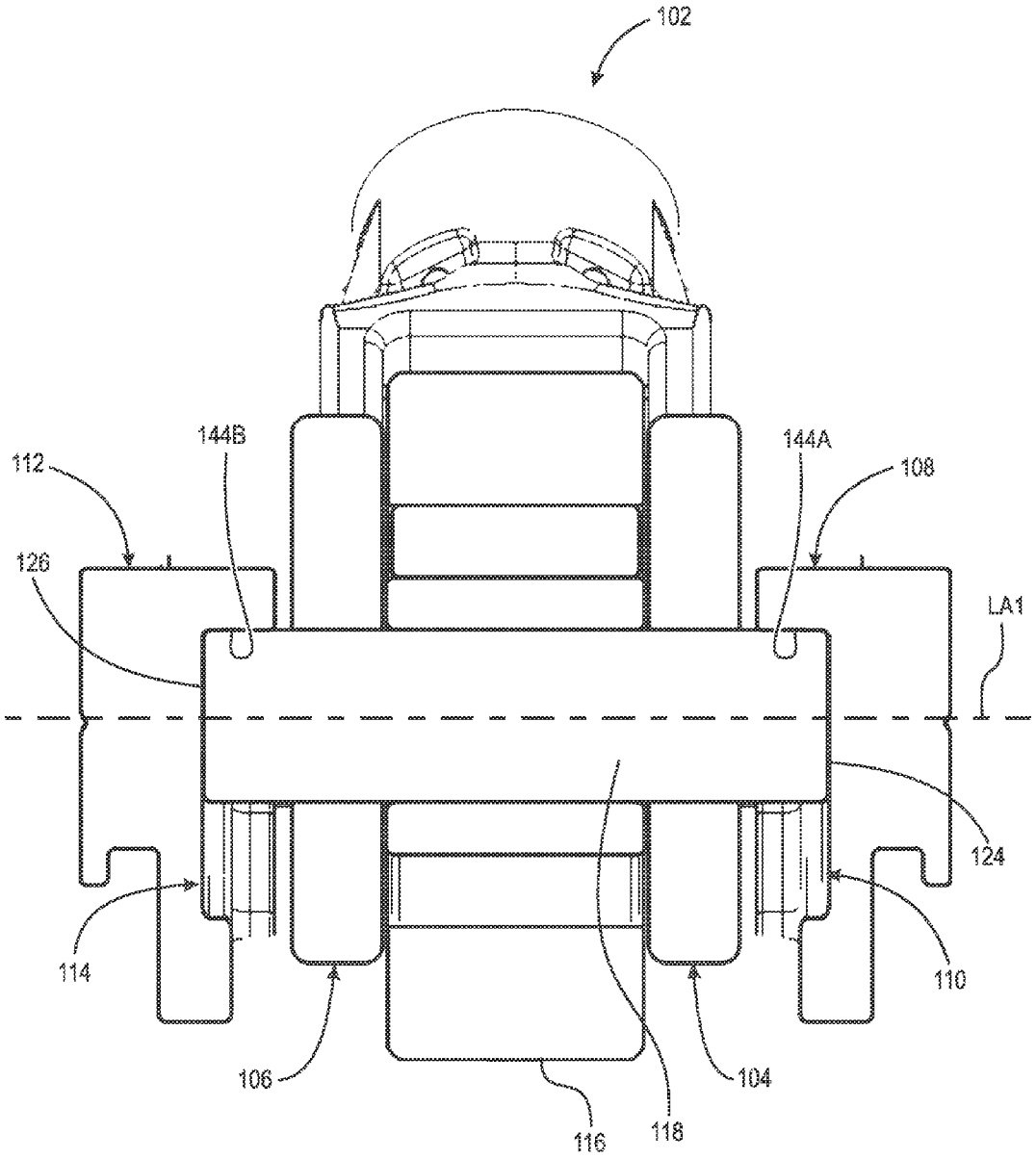
FIG. 6 is a cross-sectional view generally along line 5/6-5/6 in FIG. 2 with the secondary arms contacting overswing end stops.

FIG. 6 is a cross-sectional view generally along line 5/6-5/6 in FIG. 2 with the secondary arms contacting overswing end stops. The following should be viewed in light of FIGS. 2 through 6. Switching roller finger follower 100 includes: housing 102 with walls 104 and 106; secondary arm 108 pivotably connected to the housing and including groove 110; secondary arm 112 pivotably connected to the housing and including groove 114; and roller 116. Roller 116 is disposed between the walls 104 and 106 and includes axle 118 passing through walls 104 and 106, in particular through through-bores 120 and 122 in walls 104 and 106, respectively. Axle 118 includes end 124 disposed in groove 110 and end 126 disposed in groove 114. As further described below, contact between ends 124 and 126 and secondary arms 108 and 112, respectively, is arranged to limit an extent of rotation of secondary arms 108 and 112 with respect to housing 102.

In an example embodiment, grooves 110 and 114 are formed as indentations in surfaces 128 and 130 of arms 108 and 112, respectively, that is, the grooves do not pass completely through material forming the secondary arms. In an example embodiment (not shown), grooves 110 and 114 pass completely through material forming the secondary arms.

Walls 104 and 106 includes walls surfaces 132 and 134, respectively, facing each other and roller 116 is disposed between surfaces 132 and 134. Axle 118 includes longitudinal axis LA1, wall 104 includes surface 136 facing in axial direction AD1 parallel to longitudinal axis LA1, and wall 106 includes surface 138 facing in axial direction AD2, opposite AD1. End 124 of axle 118 extends past surface 136 in direction AD1 and end 126 of axle 118 extends past surface 138 in direction AD2.

Switching roller finger follower 100 includes axle 140, with longitudinal axis LA2, passing through walls 104 and 106. Secondary arms 108 and 112 are engaged with axle 140 as is known in the art and are pivotable about axle 140. Groove 110 is bounded by transport stop end 142A and overswing stop end 144A. Groove 114 is bounded by transport stop end 142B and overswing stop end 144B. Rotation of secondary arms 108 and 112 about axle 140 is blocked in rotational direction RTD1 by contact of ends 124 and 126 with ends 144A and 144B. Rotation of secondary arms 108 and 112 about axle 140 is blocked in rotational direction RTD2, opposite direction RTD1, by contact of ends 124 and 126 with ends 142A and 144B. Center line 146 connects ends 142A and 144A at fixed distance D1 from longitudinal axis LA2, in direction RD1 orthogonal to axis LA2. The discussion regarding centerline 146 is applicable to groove 114.

Groove 110 is bounded by side walls 148 and 150 at fixed distances D2 and D3, respectfully, from axis LA2 in a direction RD1. Line L1 orthogonal to axis LA2 passes through axle 118 and side walls 148 and 150. The discussion regarding side walls 148 and 150 is applicable to groove 114.

Figure 7:
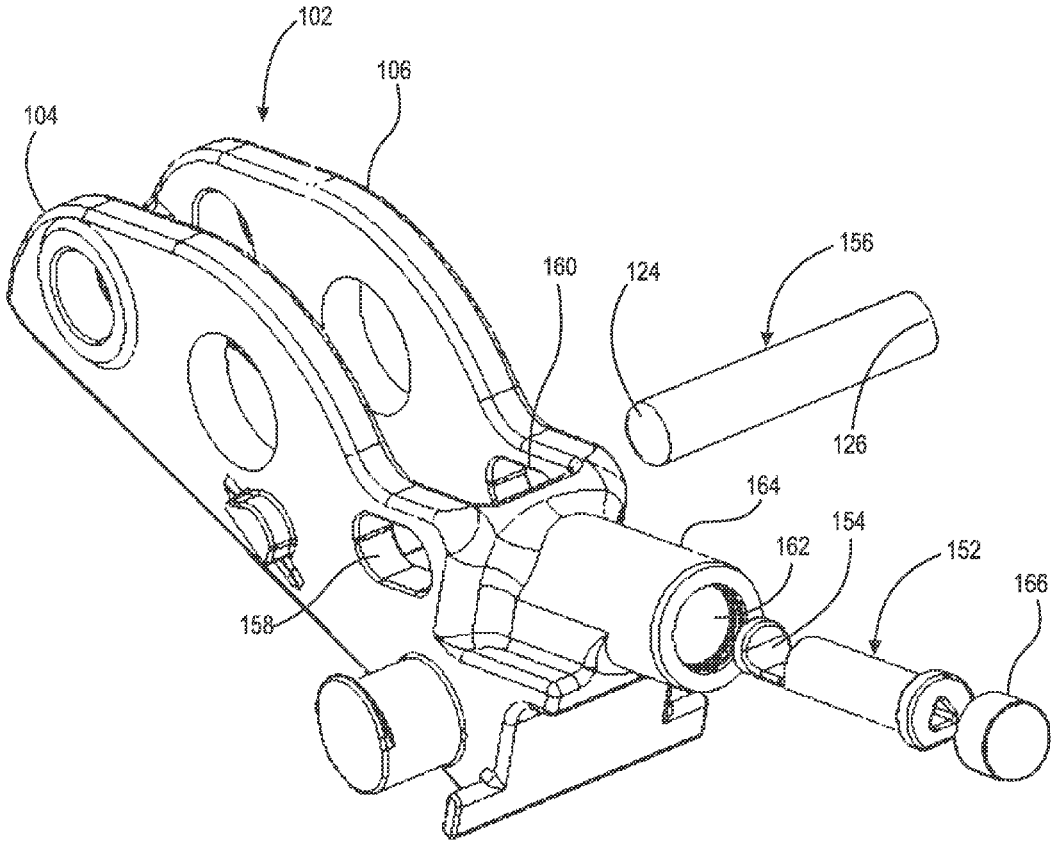
FIG. 7 is an exploded view of the switching roller finger follower in FIG. 2 with the secondary arms and roller removed.

FIG. 7 is an exploded view of switching roller finger follower 100 in FIG. 2 with the secondary arms and roller removed. The following should be viewed in light of FIGS. 2 through 7. Switching roller finger follower 100 includes shuttle pin 152 with notch 154 and locking pin 156 passing through the notch. Locking pin 156 passes through slots 158 and 160 in walls 104 and 106, respectively. Shuttle pin is at least partially disposed in passageway 162 in locking barrel 164. Seal 166 seals passageway 162. As is known in the art, in a locked mode for switching roller finger follower 100, locking pin 156 is positioned to block rotation of secondary arms 108 and 112 about axle 140.

Figure 8:
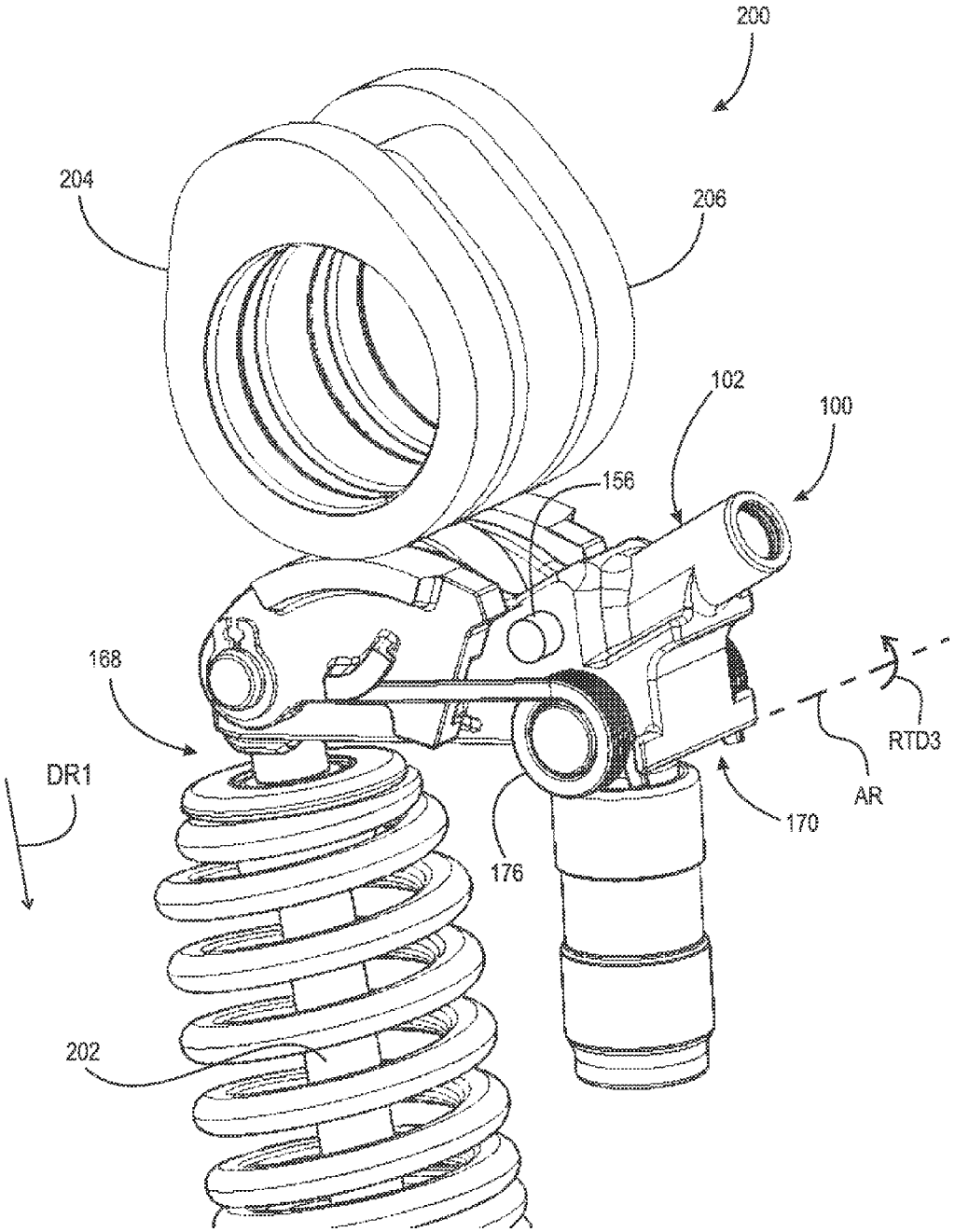
FIG. 8 is a perspective view of the switching roller finger follower of FIG. 2 in an unlocked mode and engaged with a valve train.
Figure 9:
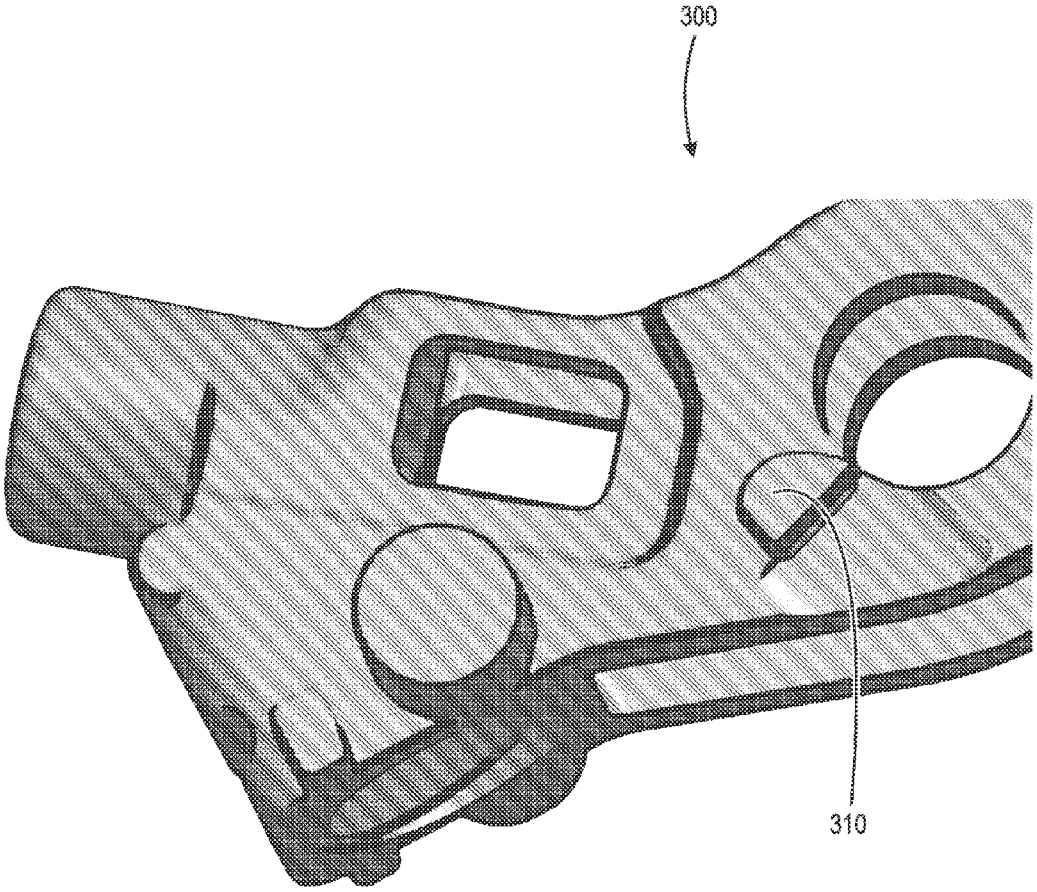
FIG. 9 is a perspective view of a protrusion on a housing of a prior art switching roller finger follower for engaging with ends stops on a secondary arm; and, FIG. 10 is a perspective view of end stops on a prior art secondary arm.
Figure 10:
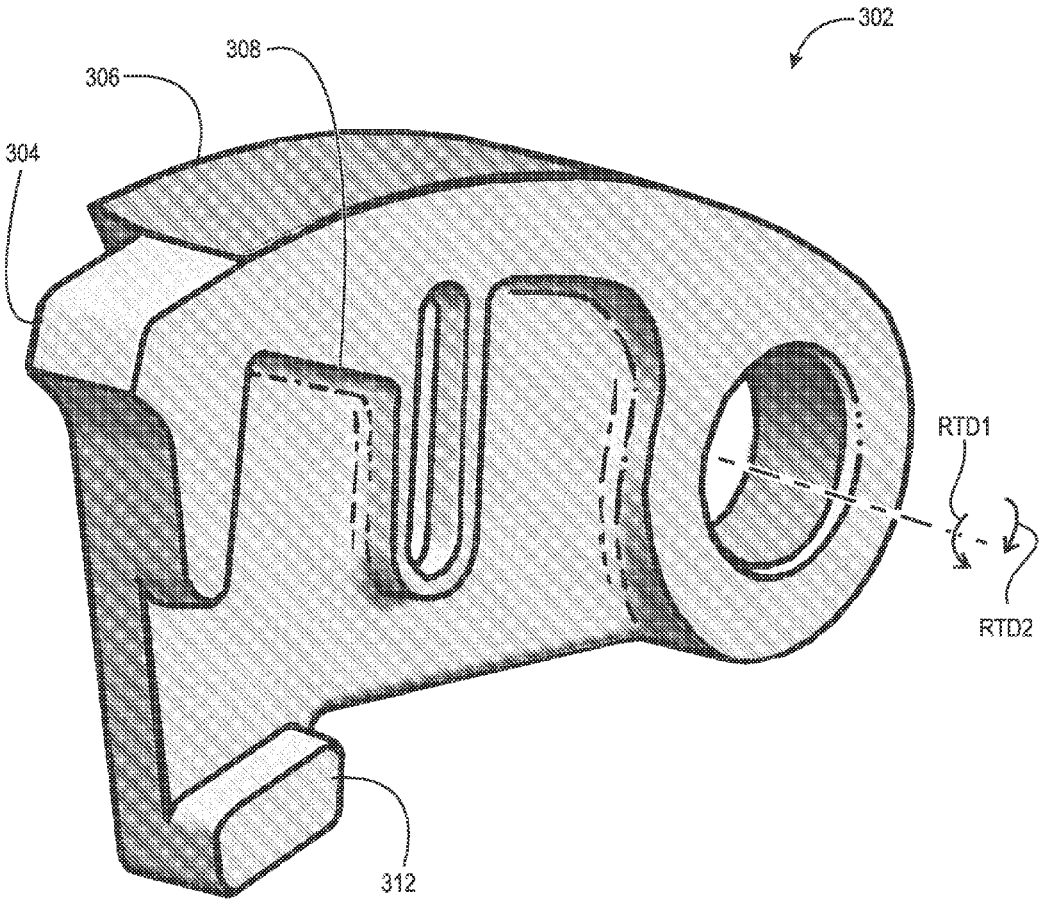

FIG. 8 is a perspective view of switching roller finger follower 100 of FIG. 2 in an unlocked mode and engaged with valve train 200. The following should be viewed in light of FIGS. 2 through 8. Follower 100 includes contact surface 168 and attachment portion 170 arranged to pivotably connect the housing 102 to a support element. The contact surface is arranged to contact valve stem 202. In the locked mode, cam lobes 204 and 206 of a cam shaft (not shown) for valve train 200, including valve stem 202, are arranged to contact arms 108 and 112, in particular contact surfaces 172 and 174, respectively. Since rotation of arms 108 and 112 is blocked by contact with locking pin 156, the pressure applied by the cam lobes causes the follower to pivot around axis AR for the connection point in direction RTD3. Via contact surface 166, follower 100 pushes the stem in direction DR1, for example, to open a valve including the valve stem.

In the unlocked mode, when the cam lobes contact secondary arms 108 and 112, the arms are free to pivot about axle 140, for example, in direction RTD1. Thus, the contact between the cam lobes and secondary arms 108 and 112 is accommodated by the pivoting such that contact between the cam lobes and secondary arms 108 and 112 does not cause housing 102 to displace with respect to the support element. Therefore, the cam lobes do not cause follower 100 to operate the valve. Springs 176 and 178 urge arms 108 and 112, respectively, in direction RTD2 to ensure that arms 108 and 112 are in position for the locking mode.

As noted above, excessive rotation of arms 108 and 112 can cause malfunctioning of follower 100. For example, in a mis-switch of follower 100, endstops 142A/B and 144A/B contact ends 124 and 126 with significant force. Advantageously, axle 118 is extremely robust and provides the desired rotational blockage of arms 108 and 112 without incurring damage. Thus, the use of ends 124 and 126 to engage endstops 142A/B and 144A/B ensures that in the event of malfunction of follower 100, for example, due to a mis-switch, rotation of arms 108 and 112 is limited in a manner enabling follower 100 to recover from the malfunction.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

The invention claimed is:

1. A switching roller finger follower, comprising:
- a housing including first and second walls;
- a first secondary arm pivotably connected to the housing and including a first groove;
- a second secondary arm pivotably connected to the housing and including a second groove;
- a roller:
  - disposed between the first and second walls; and,
  - including a first axle passing through the first and second walls and having:
    - a first end disposed in the first groove; and,
    - a second end disposed in the second groove; and,
- a second axle passing through the first and second walls, wherein the first and second secondary arms are pivotable about the second axle.

2. The switching roller finger follower of claim 1, wherein contact between the first and second ends and the first and second secondary arms is arranged to limit an extent of rotation of the first and second secondary arms with respect to the housing.

3. The switching roller finger follower of claim 1, wherein:
- the first groove is bounded by third and fourth ends in the first secondary arm;
- the second groove is bounded fifth and sixth ends in the second secondary arm; and,
- rotation of the first and second secondary arms about the second axle is blocked:
  - in a first direction by contact of the first and second ends of the first axle with the third and fifth ends; and,
  - in a second direction, opposite the first direction, by contact of the first and second ends of the first axle with the fourth and sixth ends.

4. The switching roller finger follower of claim 3, wherein a first center line connecting the respective third and fourth ends of the first groove is at a fixed distance, from the longitudinal axis for the second axle, in a direction orthogonal to the longitudinal axis for the second axle.

5. The switching roller finger follower of claim 1, wherein:
- the first and second walls include first and second surfaces, respectively facing each other; and,
- the roller is disposed between the first and second surfaces.

6. The switching roller finger follower of claim 1, wherein:
- the first axle includes a longitudinal axis;
- the first wall includes a first surface facing in a first axial direction parallel to the longitudinal axis;
- the second wall includes a second surface facing away from the first surface in a second axial direction, opposite the first axial direction;
- the first end of the axle extends past the first surface in the first axial direction; and,
- the second end of the axle extends past the second surface in the second axial direction.

7. The switching roller finger follower of claim 1, wherein:
- the first axle includes a longitudinal axis;
- the first groove is bounded by first and second side walls at first and second fixed distances, respectfully, from the longitudinal axis in a direction orthogonal to the longitudinal axis;
- the second groove is bounded by third and fourth side walls at the first and second fixed distances, respectfully, from the longitudinal axis in the direction orthogonal to the longitudinal axis;
- a first line orthogonal to the longitudinal axis passes through the first axle and the first and second side walls; and,
- a second line orthogonal to the longitudinal axis passes through the first axle and the third and fourth side walls.

8. The switching roller finger follower of claim 1 further comprising:

a locking pin passing through first and second slots the first and second walls, respectively; and, a shuttle pin including a notch, wherein:

the housing includes a locking barrel with a passageway;

the shuttle pin is at least partially disposed in the passageway;

the locking pin passes through the notch; and, in a locked mode, the locking pin is positioned to block rotation of the first and second secondary arms.

9. A switching roller finger follower, comprising:

a housing including first and second walls;

a first secondary arm pivotably connected to the housing and including a first groove with first and second ends;

a second secondary arm pivotably connected to the housing and including a second groove with third and fourth ends; and, a roller:

disposed between the first and second walls; and, including a first axle passing through the first and second walls and having:

a first end disposed in the first groove; and, a second end disposed in the second groove, wherein:

the first and third ends block pivoting of the first and second secondary arms in a first direction; and, the second and fourth ends block pivoting of the first and second secondary arms in a second direction opposite the first direction.

10. The switching roller finger follower of claim 9, further comprising:

a second axle passing through the first and second walls, wherein:

the first and second secondary arms are engaged with the second axle and are pivotable about the second axle;

the first groove is bounded by third and fourth ends in the first secondary arm;

the second groove is bounded fifth and sixth ends in the second secondary arm; and, rotation of the first and second secondary arms about the second axle is blocked:

in a first direction by contact of the first and second ends of the first axle with the third and fifth ends; and, in a second direction, opposite the first direction, by contact of the first and second ends of the first axle with the fourth and sixth ends.

11. The switching roller finger follower of claim 9, wherein:

the first axle includes a longitudinal axis;

the first wall includes a first surfaces facing in a first axial direction parallel to the longitudinal axis;

the second wall includes a second surfaces facing away from the first surface in a second axial direction, opposite the first axial direction;

the first end of the axle extends past the first surface in the first axial direction; and, the second end of the axle extends past the second surface in the second axial direction.

12. The switching roller finger follower of claim 9 further comprising:

a locking pin passing through first and second slots the first and second walls, respectively; and, a shuttle pin including a notch, wherein:

the housing includes a locking barrel with a passageway;

the shuttle pin at least partially disposed in the passageway;

the locking pin passes through the notch; and, in a locked mode, the locking pin is positioned to block rotation of the first and second secondary arms.

13. A method of fabricating a roller finger follower, comprising:

disposing a roller between first and second walls for a housing;

passing a first axle through the roller and through first and second through-bores in the first and second walls, respectively;

passing a second axle through the first and second walls;

pivotably connecting first and second secondary arms to the second axle;

disposing a first end of the first axle in a first groove in the first secondary arm; and, disposing a second end of the first axle in a second groove in the second secondary arm.

14. The switching roller finger follower of claim 13, wherein:

in the locked mode:

the first and second outer arms are arranged to contact first and second cam lobes from a plurality of cam lobes; and, the first and second outer arms are arranged to contact the locking pin to block rotation of the first and second secondary arms; and, in the unlocked mode:

the first and second outer arms are arranged to contact the first and second cam lobes, respectively; and, the first and second outer arms are arranged to pivot with respect to the housing during contact with the first and second cam lobes.

15. The method of claim 13, wherein:

contact between the first and second secondary arms and the first and second ends of the first axle, respectively, is arranged to limit pivoting of the first and second secondary arms, respectively.

16. The method of claim 13, wherein:

the first and second walls include first and second surfaces, respectively facing each other; and, disposing the roller between the first and second walls includes disposing the roller between the first and second surfaces.

17. The method of claim 13, wherein:

the first axle includes a longitudinal axis;

the first wall includes a first surfaces facing in a first axial direction parallel to the longitudinal axis;

the second wall includes a second surfaces facing away from the first surface in a second axial direction, opposite the first axial direction; and, passing the first axle through the first and second through-bores includes:

extending the first end of the axle past the first surface in the first axial direction; and, extending the second end of the axle past the second surface in the second axial direction.

18. The method of claim 13, wherein:

the first axle includes a longitudinal axis;

the first groove is bounded by first and second side walls at first and second fixed distances, respectfully, from the longitudinal axis in a direction orthogonal to the longitudinal axis;

the second groove is bounded by third and fourth side walls at the first and second fixed distances, respectfully, from the longitudinal axis in the direction orthogonal to the longitudinal axis;

disposing a first end of the first axle in the first groove includes disposing the first end such that a first line orthogonal to the longitudinal axis passes through the first axle and the first and second side walls; and, disposing the second end of the first axle in the second groove includes disposing the second end such that a second line orthogonal to the longitudinal axis passes through the first axle and the third and fourth side walls.

19. The method of claim 13, further comprising:

passing a locking pin through first and second slots in the first and second walls, respectively;

placing a shuttle pin in a passageway in a locking barrel for the housing; and, passing the locking pin through a notch in the shuttle pin, wherein the locking pin is displaceable such that in a locked mode, the locking pin blocks rotation of the first and second secondary arms.

* * * * *